US008226817B2

(12) United States Patent
Gunnerman et al.

(10) Patent No.: US 8,226,817 B2
(45) **Date of Patent: *Jul. 24, 2012**

(54) NON-FRACTIONATION PROCESS FOR PRODUCTION OF LOW-BOILING FUEL FROM CRUDE OIL

(76) Inventors: Rudolf W. Gunnerman, Reno, NV (US); Peter W. Gunnerman, Reno, NV (US)

( * ) Notice: Subject to any disclaimer, the term of this patent is extended or adjusted under 35 U.S.C. 154(b) by 349 days.

This patent is subject to a terminal disclaimer.

(21) Appl. No.: 12/651,592

(22) Filed: Jan. 4, 2010

(65) Prior Publication Data

US 2011/0163007 A1 Jul. 7, 2011

(51) Int. Cl.
*C10G 11/02* (2006.01)

(52) U.S. Cl. ..... 208/46; 208/15; 208/113; 208/121; 208/290; 208/295; 208/370

(58) Field of Classification Search ..... 208/46, 208/113, 121, 290, 295, 370
See application file for complete search history.

(56) References Cited

U.S. PATENT DOCUMENTS

| | | | |
|---|---|---|---|
| 3,925,001 | A | 12/1975 | Salooja |
| 3,989,477 | A | 11/1976 | Wilson et al. |
| 4,673,488 | A | 6/1987 | Turner et al. |
| 5,069,775 | A | 12/1991 | Grosboll |
| 5,269,909 | A | 12/1993 | Ovalles et al. |
| 5,891,829 | A | 4/1999 | Vallejos et al. |
| 7,806,947 | B2 | 10/2010 | Gunnerman et al. |
| 7,880,044 | B2 | 2/2011 | Gunnerman et al. |
| 7,897,124 | B2 | 3/2011 | Gunnerman et al. |
| 2009/0249682 | A1 | 10/2009 | Gunnerman et al. |
| 2010/0324349 | A1 | 12/2010 | Gunnerman et al. |
| 2011/0000128 | A1 | 1/2011 | Gunnerman et al. |
| 2011/0049014 | A1 | 3/2011 | Gunnerman et al. |

FOREIGN PATENT DOCUMENTS

| | | | |
|---|---|---|---|
| JP | 61-242622 | A | 10/1986 |
| WO | WO 2011/025613 | A1 | 3/2011 |

*Primary Examiner* — Walter D Griffin
*Assistant Examiner* — Brian McCaig
(74) *Attorney, Agent, or Firm* — Kilpatrick Townsend & Stockton LLP.; M. Henry Heines

(57) ABSTRACT

Crude oil is reacted with a methane-containing gas in a process wherein the gas is fed to a reaction vessel to contact both the crude oil and a metallic catalyst grid that is formed from windings of a transition metal supported on an iron frame immersed in a liquid petroleum fraction, at a moderate temperature to produce a gaseous reaction product which is condensed to form an upgraded mixture of hydrocarbons with a variety of uses, including serving as an additive to crude oil for transport purposes.

20 Claims, 2 Drawing Sheets

NON-FRACTIONATION PROCESS FOR PRODUCTION OF LOW-BOILING FUEL FROM CRUDE OIL

BACKGROUND OF THE INVENTION

1. Field of the Invention

This invention lies in the field of crude oil, crude oil transport, and liquid fuels derived from crude oil.

2. Description of the Prior Art

Crude oil is the largest and most widely used source of power in the world. The fuels derived from crude oil enjoy a wide range of utility ranging from consumer uses such as fuels for automotive engines and home heating to commercial and industrial uses such as fuels for boilers, furnaces, smelting units, and power plants. Crude oil is a mixture of hydrocarbons differing widely in molecular weight, boiling and melting points, reactivity, and ease of processing. The mixture includes both light components that are of immediate utility and heavy components that have little or no utility, as well as components such as sulfur that are detrimental to the environment when carried over into the refined products. Many industrial processes have been developed to upgrade crude oil by removing, diluting, or converting the heavier components or those that tend to polymerize or otherwise solidify, notably the olefins, aromatics, and fused-ring compounds such as naphthalenes, indanes and indenes, anthracenes, and phenanthracenes.

Crude oil is found in many parts of the world, including a large number of remote locations. To process the crude, it is therefore often necessary to transport the crude over long distances to processing sites. One of the major modes of transportation is by pipeline, networks of which have been constructed in the United States and Canada as well as other parts of the world. Pipeline transport of crude oil presents certain difficulties, however, prominent among which is the high viscosity of the oil which makes pumping difficult even at mild temperatures, and particularly so in cold climates. The viscosity can be reduced by blending the crude oil with additives such as low-viscosity oils or refinery cuts, but this requires relatively large amounts of these additives and is feasible only where either light-oil fields or a refinery exist at the same site or nearby. The viscosity of heavy oil can also be reduced by heating. To achieve this, however, considerable amounts of heat are required, in addition to large capital expenditures for equipping the pipelines with heating equipment and insulation. A still further method of increasing the mobility of the oil is to add water to the oil to convert it to an emulsion prior to pumping it through the pipeline. Upon reaching its destination, the emulsion is separated into oil and water in a settling tank. To be economically viable, however, the emulsion must be formed with the aid of an emulsifier that produces a readily formed, yet stable, emulsion, and one that functions in the salinities that are often present in crude oil deposits and in the high temperatures often used to extract the oil from the deposits. The emulsifier must also be able to stabilize an emulsion with a high proportion of oil, and yet allow the emulsion to be separated at the destination. Since components of the emulsifier are often retained in the ultimate fuel, the emulsifier must also be one that is not detrimental to the environment when the fuel is burned.

Many crude oil deposits contain natural gas and other gaseous hydrocarbons, commonly referred to as "petroleum gas," that are released from the deposits together with the crude oil. These gases are released in particularly high amounts when the deposits are injected with water, steam or an inert gas to facilitate the extraction of oil from fields that have already been exhausted with pumps. Unless there is an on-site use for this petroleum gas, it presents a disposal problem. Disposal is commonly achieved by venting the gas to the atmosphere or by combusting the gas in a flare, both of which raise environmental concerns.

SUMMARY OF THE INVENTION

It has now been discovered that methane, and gas mixtures containing methane, can be utilized in the upgrading of crude oil to achieve a hydrocarbon mixture with a substantially greater proportion of low-boiling components than is typically found in crude oil. This transformation is achieved by passing the methane at moderate temperature and pressure through a reactor that contains both the crude oil and a solid metallic catalyst, drawing a gaseous product from the reactor, and condensing the gaseous product to liquid form. The liquid condensate is useful for a wide range of applications, including both fuels and additives, and is also useful for further processing, either in a refinery or as a second-stage liquid medium for reaction with further methane in the presence of the same type of catalyst in the same reactor configuration, in place of the crude oil. The product is thus derived from natural gas or other sources of methane with little or no need for disposal of gaseous by-products, and hydrocarbon values are extracted from the heavy residual components of crude oil that are otherwise useful only for paving or roofing or other similar applications. Heavy crude oils can thus be converted to upgraded refinery feedstocks for more efficient fractionation, and automotive fuels can be obtained directly from the crude oil and methane, without fractionation of the crude oil. By its consumption of methane, the invention eliminates the need for disposal of petroleum gas at oil fields, or for the recovery of the gas at the fields and transportation of the recovered gas to remote destinations for consumption. One of the many uses of the hydrocarbon mixture resulting from the process of the invention is as a blending agent for the crude oil to lower the viscosity of the crude oil and thereby increase its mobility for pumping through a long-distance pipeline. The low-viscosity blend is formed without the need for costly additives at the source, or for heating equipment at the source or in the pipeline, or for emulsion breaking and separation at the destination, and can be formed entirely from materials extracted from the oil field.

These and other features, objects, and advantages of the invention will be apparent from the description that follows.

DETAILED DESCRIPTION OF THE INVENTION AND PREFERRED EMBODIMENTS

Figure 1:
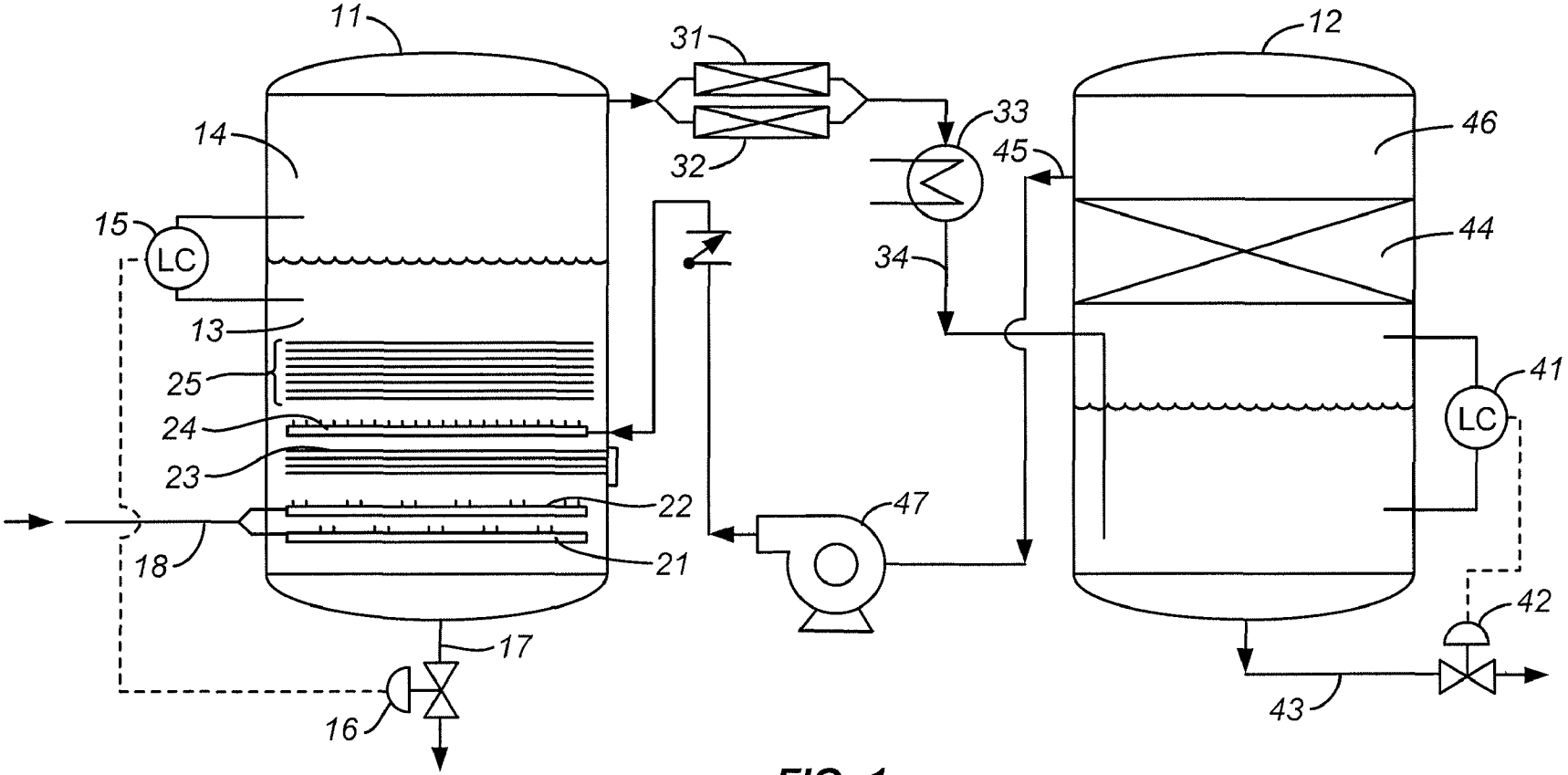
FIG. 1 is a process flow diagram embodying one example of an implementation of the invention.

The crude oil used in the practice of this invention includes any of the various grades of crude oil, with particular interest in heavy and extra heavy crude oils. As used herein, the term "heavy crude oil" refers to any liquid petroleum with an API gravity less than 20°, equivalent to a specific gravity greater than 0.934 and a density greater than 7.778 lb/US gal (932 kg/m$^3$), and the term "extra heavy crude oil" refers to any liquid petroleum with an API gravity of 15° or less (specific gravity greater than 0.96 and a density greater than 8.044 lb/US gal or 964 kg/m$^3$) and a viscosity of 1,000-10,000 centipoise and higher (up to 100,000 centipoise). Heavy crude oil is found in Alberta and Saskatchewan, Canada, and also in California, Mexico, Venezuela, Colombia, and Ecuador, as well as Central and East Africa. Extra heavy crude oil is found in Venezuela and Canada.

The methane used in the practice of this invention includes both methane itself and gas mixtures containing methane, from any natural, municipal, agricultural, ecological, or industrial source. One example of a gas mixture containing methane is "coal bed methane," otherwise known as "coal mine methane" and "abandoned mine methane." Another example is petroleum gas, of which methane is the major component, the other components including ethane, propane, propylene, butane, isobutane, butylenes, and other $C_4$+ light hydrocarbons. Hydrogen, carbon dioxide, hydrogen sulfide, and carbonyl sulfide are also present in certain cases. A further example is landfill gas, of which methane constitutes about 40-60%, with the remainder primarily carbon dioxide. A still further example is methane from industrial sources, examples of which are municipal waste treatment plants. Landfill gas is commonly derived by bacterial activity in the landfill, while gas from municipal waste treatment plants is derived by bacterial activity or by heating. Gases containing at least about 50% methane are preferred, gases with 70% or more methane more preferred, and gases with at least 85% methane still more preferred. Gases containing 90% to 100% methane are of particular interest. This includes natural gas, of which methane typically constitutes approximately 95 mole percent. Natural gas when used is preferably used without supplementation with other gases, and particularly without significant amounts of hydrogen or carbon monoxide, preferably less than 1% by volume of each. All percents in this paragraph are by volume unless otherwise stated.

The catalyst used in the practice of this invention is a transition metal catalyst, and can consist of a single transition metal or combination of transition metals, either as metal salts, pure metals, or metal alloys. Preferred catalysts for use in this invention are metals and metal alloys. Transition metals having atomic numbers ranging from 23 to 79 are preferred, and those with atomic numbers ranging from 24 to 74 are more preferred. Cobalt, nickel, tungsten, and iron, particularly in combination, are the most preferred. The transition metal can also be used in combination with metals other than transition metals. An example of such an additional metal is aluminum.

The catalyst is used in solid form and can either be immersed in the crude oil, positioned in the head space above the crude oil, or both. In either case, the methane-containing gas is bubbled through the oil and through or past the catalyst in a continuous-flow reaction. The catalyst can assume any form that allows intimate contact with both the methane and the crude oil and allows free flow of gas over and past the catalyst. Examples of suitable forms of the catalyst are pellets, granules, wires, mesh screens, perforated plates, rods, and strips. Granules and wires suspended across plates or between mesh matrices such as steel or iron wool are preferred for their relatively accessible high surface area. When granules are used, the granules can be maintained in a fluidized state in the reaction medium or held stationary in the form of a fixed bed. A preferred form of the catalyst is a metallic grid, which term is used herein to denote any fixed form of metallic catalyst that is contains interstices or pores that allow gas to pass through the grid. The term thus encompasses packed beds, screens, open-weave wire networks, and any other forms described above. The metal can be in bare form or supported on inert supports as coatings or laminae over ceramic substrates. A single catalyst grid spanning the width of the reactor can be used, or two or more such grids can be arranged in a vertical stack within the reactor, optionally with a small gap between adjacent grids. When two or more catalyst grids are used, at least one grid preferably resides in the head space above the liquid level. In some cases, the entire stack of grids resides in the head space, although the lowermost grid may be in intermittent contact with the liquid as the bubbling of the methane-containing gas through the liquid causes splashing of the liquid during the reaction.

When the catalyst is in the form of wires, individual cobalt, nickel, aluminum, and tungsten wires, for example, of approximately equal diameter and length, can be strung across a frame of cast iron, pig iron, gray iron, or ductile iron to form an open-mesh network which can then be supported inside the reactor. The wires are preferably supported on the frame by being wound around pegs affixed to the frame, where the pegs are formed of a material that has an electrical resistivity that is substantially higher than the electrical resistivities of both the windings and of the frame. In preferred embodiments, the electrical resistivity of the pegs is at least about $15\times10^{-8}$ ohm meters at 100° C. Chromium and chromium alloys are examples of materials that meet this description. A reactor can contain a single frame strung with wires in this manner or two or more such frames, depending on the size of the reactor. In a still further variation, the catalyst wire can be wound as a coil or other wrapping around or over piping that serves as a gas distributor for incoming gas.

When wires of the metal catalyst are used, the wires are preferably wound on the frame in such a manner that an electric potential is produced between the wires and the iron frame when the reaction is running. The potential will vary with the distance between the site on the windings and the site on the frame between which the potential is measured, and in some cases, with the locations of the sites themselves. In general, the greater the distance, the larger the potential. When the frame is circular in outer diameter with reinforcing bars or rods within the perimeter and the windings converge at the center of the frame, the electric potential is most effectively measured between the windings at the center and a location on the frame itself that is radially displaced from the center, for example a distance equal to approximately half the radius of the frame. With gas feed rates to the reactor of 50 standard cubic feet per hour (SCFH) or greater, the electric potential between these points will be at least about 10 mV, preferably from about 10 mV to about 10V, most preferably with a time-averaged value of from about 10 mV to about 3V, and mean fluctuation frequencies of from about 30 Hz to about 300 Hz. With gas feed rates within the range of about 10,000 cubic feet per hour to about 100,000 SCFH, the time-averaged electric potential between these points can be from about 100 mV to about 200 mV, the maximum values can be from about 1V to about 5V, and the frequency can be from about 50 $sec^{-1}$ to about 1,000 $sec^{-1}$.

The methane-containing gas is preferably supplied to the reactor through one or more gas distributors to convert the gas stream to small bubbles for release into the reaction vessel below the liquid level. For a reactor of circular cross section, the distributors may have a wheel-and-spokes configuration or any other shape that includes a network of hollow pipes with an array of apertures. To further enhance the distribution, these pipes, or at least the apertures, can be covered with a steel mesh or steel wool in combination with wires of the various metals listed above, to intercept the gas bubbles and reduce them further in size before they enter the reaction medium.

The reaction is performed under non-boiling conditions to maintain the crude oil in a liquid state and to prevent or at least minimize the vaporization of components from the crude oil and their escape in unreacted form from the reaction vessel with the product. An elevated temperature, i.e., a temperature above ambient temperature, is used, preferably one that is about 80° C. or above, more preferably one within the range of about 100° C. to about 250° C., most preferably within the range of about 150° C. to about 200° C. The operating pressure can vary as well, and can be either atmospheric, below atmospheric, or above atmospheric. The process is readily and most conveniently performed at either atmospheric pressure or a pressure moderately above atmospheric. Preferred operating pressures are those within the range of about 1 atmosphere to about 3 atmospheres, most preferably within the range of about 1 atmosphere to about 1.5 atmospheres.

The flow rate of introduction of gas into the reactor can vary and is not critical to the invention. In most cases, best results in terms of product quality of economic operation will be obtained with a gas introduction rate of from about 60 to about 500, and preferably from about 100 to about 300, SCFH per U.S. gallon of crude oil in the reactor (approximately 106 to 893, and preferably 178 to 535, liter/min of gas per liter of the oil). The reaction will cause depletion of the crude oil volume at a slow rate, which can be corrected by replenishment with fresh crude oil to maintain a substantially constant volume of liquid in the reactor. The replenishment rate needed to accomplish this is readily determined by simple observation of the liquid level in the tank, and in most cases will range from about 0.5 to about 4.0 parts by volume per hour per 10 parts by volume initially charged to the reactor for continuous, steady-state operation. In presently preferred operation, the volumetric production of condensed liquid product per volume of crude oil consumed ranges from about 0.5 to about 5.0, preferably from about 1.0 to about 3.0, and test data currently available upon the date of application for this patent indicates a value of approximately 2.0 for this ratio.

The gaseous product emerging from the reactor is condensed to a liquid whose distillation curve is shifted downward relative to petroleum by about 100 degrees Celsius or more. The liquid can be used directly as a fuel, a refinery feedstock, a blending agent for pipeline transport, or any of various other uses outside the plant. Alternatively, the condensed liquid can be used as the liquid phase in a second-stage reaction with a gaseous reactant from the same source as the first reactant, the same or similar catalyst, and the same or similar reaction conditions, to produce a secondary condensate of a still higher grade. The secondary condensate will have more enhanced properties, making it even more suitable for each of the various end uses set forth above.

The Figures hereto present examples of process flow diagrams for implementation of the present invention in a production facility. The flow diagram in FIG. 1 includes a reaction vessel 11 and a product vessel 12, each of which is a closed cylindrical tank. The reaction vessel 11 is charged with crude oil 13 occupying a portion of the internal volume of the vessel, leaving a gaseous head space 14 above the oil. The liquid level is maintained by a level control 15 which is actuated by a pair of float valves inside the vessel. The level control 15 governs a motor valve 16 on a drain line 17 at the base of the vessel.

Natural gas or other methane-containing gas is fed to the reaction vessel 11 underneath the liquid level at an inlet gas pressure of from about 3 psig to about 20 psig, through a gas inlet line 18 which is divided among two gas distributors 21, 22 inside the reactor vessel, each distributor spanning the full cross section of the vessel. The number of feed gas distributors can vary and can be greater or lesser than the two shown. A resistance heater 23 is positioned in the reactor above the gas distributors, and a third gas distributor 24 is positioned above the resistance heater. The third gas distributor 24 receives return gas from the product receiving vessel 12 as explained below.

Positioned above the three gas distributors 21, 22, 24 and the resistance heater 23 but still beneath the liquid level are a series of catalyst grids 25 arranged in a stack. Each grid is a circular frame with metallic catalyst wires strung across the frame. With wires that are 1 mm in diameter, for example, and with individual wires of each of four metals, such as for example cobalt, nickel, aluminum, and tungsten, two pounds of each metal wire can be used per ring, or eight pounds total per ring. In a preferred embodiment, seven rings are used, each wound with the same number and weight of wires. Screens of wire mesh are placed between adjacent plates for further reduction of the sizes of the gas bubbles. Stainless steel or aluminum screens of 40-mesh (U.S. Sieve Series) can be used.

Product gas is drawn from the head space 14 of the reaction vessel 11 and passed through a supplementary catalyst bed of the same catalyst material as the catalyst grids 25 of the reaction vessel. In the diagram shown, two such supplementary catalyst beds 31, 32 of identical construction and catalyst composition are arranged in parallel. The supplementary catalyst beds in this embodiment are metallic wire screens, grids, or perforated plates similar to those of the catalyst grids 25 in the reactor vessel 11. The supplementary catalyst promotes the same reaction that occurs in the reaction vessel 11 for any unreacted material that has been carried over with the product gas drawn from the reaction vessel. Product gas emerging from the supplementary catalyst beds is passed through a condenser 33, and the resulting condensate 34 is directed to the product vessel 12 where it is introduced under the liquid level in the product vessel.

The liquid level in the product vessel 12 is controlled by a level control 41 that is actuated by a pair of float valves inside the vessel and that governs a motor valve 42 on a liquid product outlet line 43 at the base of the vessel. Above the liquid level is a packed bed 44 of conventional tower packings. Examples are Raschig rings, Pall rings, and Intalox saddles; other examples will be readily apparent to those familiar with distillation towers and column packings. The packing material is inert to the reactants and products of the system, or at least substantially so, and serves to entrap liquid droplets that may be present in the gas phase and return the entrapped liquid back to the bulk liquid in the lower portion of the vessel. Unreacted gas 45 is withdrawn from the head space 46 above the packed bed by a gas pump 47. The pump outlet is passed through a check valve 48 and then directed to the reaction vessel 11 where it enters through the gas distributor 24 positioned between the resistance heater 23 and the catalyst grids 25.

Figure 2:
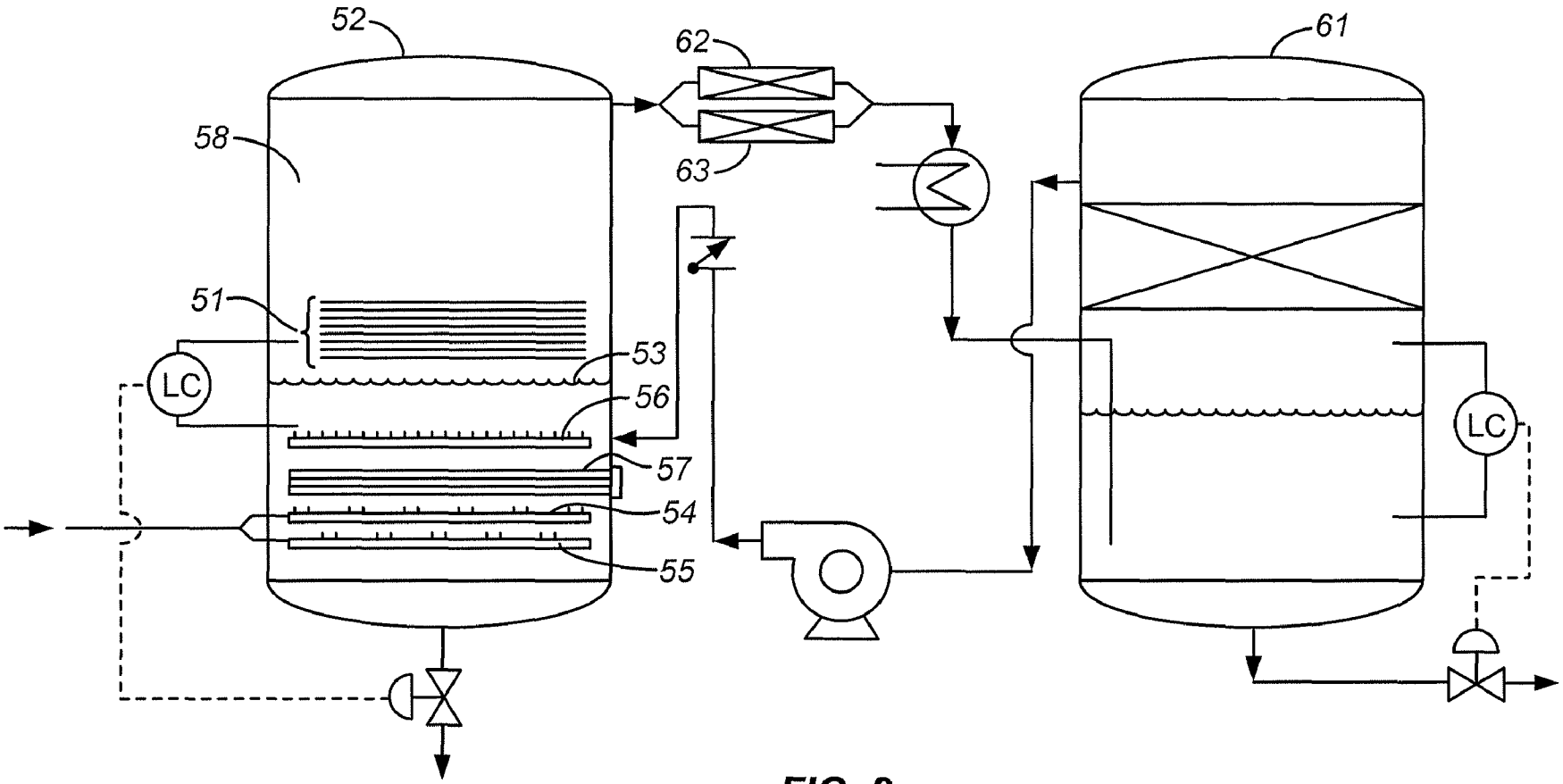
FIG. 2 is a process flow diagram embodying a second example of an implementation of the invention.

The production facility in FIG. 2 is identical to that of FIG. 1 except that the catalyst grids 51 are mounted at a height in the reaction vessel 52 that is above the liquid level 53 of the crude oil. Methane-containing gas is fed to the reaction vessel 52 underneath the liquid level as in FIG. 1, at the same pressure and through gas distributors 54, 55 similarly placed, and gas from the product receiving vessel 61 enters the reaction vessel 52 through a third gas distributor 56, also under the liquid level. A resistance heater 57 is positioned in the reaction vessel in the same location as the resistance heater of FIG. 1. As in FIG. 1, product gas is drawn from the head space 58 of the reaction vessel 52 above the catalyst grids 51. The remaining units in the flow diagram, including the product receiving vessel 61, the supplementary catalyst beds 62, 63, and their associated components, connecting lines, and valves, are identical to those of FIG. 1.

Alternatives to the units described above and shown in the figure will be readily apparent to the skilled chemical engineer. The resistance heater, for example, can be replaced by heating jackets, heating coils using steam or other heat-transfer fluids, or radiation heaters. Heating of the reaction vessel can also be achieved by recirculation of heat transfer fluid between the coolant side of the condenser and the reaction vessel. The gas distributors for the inlet feed and the recycle gas can be perforated plates, cap-type distributors, pipe distributors, or other constructions known in the art. Liquid level control can be achieved by float-actuated devices, devices measuring hydrostatic head, electrically actuated devices, thermally actuated devices, or sonic devices. The condenser can be a shell-and-tube condenser, either horizontal or vertical, or a plate-and-frame condenser, and either co-current or counter-current. The condensers can be air-cooled, water-cooled, or cooled by organic coolant media such as automotive anti-freeze or other glycol-based coolants.

Example

This example illustrates the present invention in a process utilizing natural gas and Trap Springs crude oil (Railroad Valley, Nye County, Nevada, USA). The equipment used was as shown in FIG. 2, with a tank having a volumetric capacity of 50 gallons (190 liters) as the reaction vessel. The tank was initially charged with 12 gallons (45 liters) of the crude oil and was maintained at a temperature of 340° F. (171° C.) and a pressure of 3.5 psig (125 kPa). The natural gas was bubbled through the crude oil at a rate of 210 SCFH. The catalyst grids consisted of nickel wire, tungsten wire, cobalt wire (an alloy containing approximately 50% cobalt, 10% nickel, 20% chromium, 15% tungsten, 1.5% manganese, and 2.5% iron), and aluminum wire over a gray iron frame. Once fully started, the vapors drawn from the tank head space were condensed to produce liquid product at a rate of 3.5 gallons per hour (13.25 liters per hour), and two gallons of the liquid product, termed a first stage product, were produced for every gallon of reaction medium depleted. (All gallons listed herein are U.S. gallons.) Residual crude oil was then removed from the tank and replaced with twelve gallons of the first stage product, and the process repeated, i.e., further natural gas was bubbled through the first-stage product in the tank under the same conditions as when the tank contained the crude oil. The vapors drawn from the tank head space were condensed as they were formed, and the condensate was collected as a second stage product.

The test results on the initial crude oil and samples of both the first stage product and the second stage product, in both cases after one hour of operation, are listed in the following table.

TABLE

Raw Material and Product Data

| Test and Protocol | Results | | | |
|---|---|---|---|---|
| Distillation corrected to | | Temperature (° C.) | | |
| 760 mm Hg (1 atm); ASTM D86 | Percent Recovered | Crude Oil | 1st Stage Product | 2nd Stage Product |
| | 0(1) | 114.7 | 91.5 | 134.6 |
| | 5 | 179.3 | 130.1 | 153.7 |
| | 10 | 215.5 | 142.3 | 162.5 |
| | 15 | 246.7 | 153.1 | 169.6 |
| | 20 | 273.9 | 162.7 | 175.4 |
| | 30 | 352.9 | 181.6 | 186.8 |
| | 40 | 359.6 | 199.8 | 197.1 |
| | 50 | 349.6 | 216.7 | 206.9 |
| | 60 | 348.8 | 233.2 | 216.9 |
| | 70 | —(2) | 248.1 | 226.8 |
| | 80 | — | 264.0 | 238.0 |
| | 85 | — | 273.9 | 245.1 |
| | 90 | — | 286.5 | 254.2 |
| | 95 | — | 309.7 | 270.1 |
| | End | — | 315.1 | 283.4 |
| | Recovery | 70 | 97% | 97.3% |
| API Gravity at 60° F.; ASTM D287 | | 23.2° API | 44.0° API | 46.0° API |
| Sulfur by Microcoulometry; ASTM D 3120 | | 19,800 mg/kg | 2,800 mg/kg | 1,400 mg/kg |
| Viscosity @ 40° C.; ASTM D 445a-1.8 | | 75.32 $mm^2/s$ | 1.43 $mm^2/s$ | 1.34 $mm^2/s$ |
| Flash Point; ASTM D93 (Proc. A) | | | | 35.0° C. |
| Ash; ASTM D482 | | | | <0.001% (wt) |
| Copper Corrosion @ 50° C.; ASTM D130 | | | | 1A 3 hours |
| Cloud Point; ASTM D2500 | | | | −48° C. |
| Ramsbottom Carbon 10% Residue; ASTM D524 | | | | 0.09% (wt) |

TABLE-continued

| Raw Material and Product Data | | | | |
|---|---|---|---|---|
| Test and Protocol | Results | | | |
| Distillation corrected to | Temperature (° C.) | | | |
| 760 mm Hg (1 atm); ASTM D86 | Percent Recovered | Crude Oil | 1st Stage Product | 2nd Stage Product |
| Cetane Index; ASTM D976 | | | | 48.5 |
| Lubricity by HFRR(3) at 60° C.; ASTM | | | | 40 μm |

(1)Initial boiling point
(2)Sample would not distill past 70% recovery
(3)High-Frequency Reciprocating Rig In the claims appended hereto, the terms "a" and "an" are intended to mean "one or more." The term "comprise" and variations thereof such as "comprises" and "comprising," when preceding the recitation of a step or an element, are intended to mean that the addition of further steps or elements is optional and not excluded. All patents, patent applications, and other published reference materials cited in this specification are hereby incorporated herein by reference in their entirety. Any discrepancy between any reference material cited herein and an explicit teaching of this specification is intended to be resolved in favor of the teaching in this specification. This includes any discrepancy between an art-understood definition of a word or phrase and a definition explicitly provided in this specification of the same word or phrase.

What is claimed is:

1. A process for producing a liquid fuel from a gas containing at least about 50% methane by volume, said process comprising:

(a) contacting said gas with crude oil and a metallic catalyst grid, both said crude oil and said metallic catalyst grid contained in a reaction vessel, at a temperature of about 80° C. or above but below the boiling temperature of said crude oil, said metallic catalyst grid comprising windings of a transition metal supported on an iron frame;

(b) recovering a gaseous reaction product formed in said reaction vessel; and (c) condensing said gaseous reaction product to said liquid fuel.

2. The process of claim 1 wherein said metallic catalyst grid is immersed in said crude oil.

3. The process of claim 1 wherein said crude oil occupies a portion of said reaction vessel and thereby forms a liquid level in said reaction vessel and a head space above said liquid level, said metallic catalyst grid resides in said head space, step (a) comprises feeding said gas to said reaction vessel under said liquid level, and step (b) comprises recovering said gaseous reaction product from said head space.

4. The process of claim 1 wherein said crude oil occupies a portion of said reaction vessel and thereby forms a liquid level and a head space above said liquid level, said reaction vessel contains a plurality of said metallic catalyst grids and at least one of said metallic catalyst grids resides in said head space, step (a) comprises feeding said gas to said reaction vessel under said liquid level, and step (b) comprises recovering said gaseous reaction product from said head space.

5. The process of claim 1 wherein said crude oil occupies a portion of said reaction vessel and thereby forms a liquid level and a head space above said liquid level, said reaction vessel contains a plurality of said metallic catalyst grids residing in said head space, step (a) comprises feeding said gas to said reaction vessel under said liquid level, and step (b) comprises recovering said gaseous reaction product from said head space.

6. The process of claims 1 or 4 wherein said gas contains at least about 70% methane by volume.

7. The process of claims 1 or 4 wherein said gas contains at least about 85% methane by volume.

8. The process of claims 1 or 4 wherein said gas is natural gas.

9. The process of claims 1 or 4 wherein said windings are wound in a configuration that produces a fluctuating electric potential between said windings and said frame.

10. The process of claim 9 wherein said fluctuating electric potential has a time-averaged voltage of from about 10 mV to about 3V and a frequency of from about 30 Hz to about 300 Hz.

11. The process of claims 1 or 4 wherein said windings are supported on said frame by pegs of chromium or a chromium alloy.

12. The process of claims 1 or 4 wherein step (a) is performed at a temperature of from about 100° C. to about 250° C.

13. The process of claims 1 or 4 wherein step (a) is performed at a temperature of from about 150° C. to about 200° C.

14. The process of claims 1 or 4 wherein step (a) is performed at a temperature of from about 150° C. to about 200° C. and a pressure of from about 1 atmosphere to about 1.5 atmospheres.

15. The process of claims 1 or 4 wherein said windings are of a plurality of transition metals.

16. The process of claim 15 wherein said metals of said plurality of transition metals are cobalt, nickel and tungsten.

17. The process of claims 1 or 4 wherein said catalyst further comprises windings of aluminum supported on said iron frame.

18. The process of claims 1 or 4 wherein said catalyst comprises windings of cobalt, nickel, tungsten, and aluminum on an iron frame.

19. A process for producing a liquid fuel, said process comprising:

(a) passing a first gas containing at least about 50% methane by volume through crude oil and a metallic catalyst grid, both said crude oil and said metallic catalyst grid contained in a first reaction vessel, with said crude oil at a temperature of about 80° C. or above but below the boiling temperature of said crude oil, said metallic catalyst grid comprising windings of a transition metal supported on an iron frame;

(b) recovering a first gaseous reaction product from said first reaction vessel;

(c) condensing said first gaseous reaction product to form a first condensate;

(d) passing further gas containing at least about 50% methane by volume through said first condensate and a metallic catalyst grid, both said first condensate and said metallic catalyst grid contained in a second reaction vessel, with said first condensate at a temperature of about 80° C. or above but below the boiling temperature of said first condensate, said metallic catalyst grid comprising windings of a transition metal supported on an iron frame;

(e) recovering a second gaseous reaction product from said second reaction vessel;

(f) condensing said second gaseous reaction product to form said liquid fuel.

20. The process of claim 19 wherein said crude oil occupies a portion of said first reaction vessel and thereby forms a liquid level in said first reaction vessel and a head space above said liquid level; said first condensate occupies a portion of said second reaction vessel and thereby forms a liquid level in said second reaction vessel and a head space above said liquid level; said metallic catalyst grid in said first reaction vessel resides in said head space in said first reaction vessel and said metallic catalyst grid in said first reaction vessel resides in said head space in said first reaction vessel, steps (a) and (d) both comprise feeding said gas to said first and second reaction vessels respectively under said liquid levels, and steps (b) and (e) both comprise recovering said gaseous reaction products from said head spaces.

* * * * *